US005379708A

United States Patent [19]

Moll et al.

[11] Patent Number: 5,379,708

[45] Date of Patent: Jan. 10, 1995

[54] METHOD AND DEVICE FOR FORMING THREE-DIMENSIONAL ENVELOPES

[75] Inventors: Philipp Moll; Hans Behrens, both of Aachen, Germany

[73] Assignee: Moll Automatische Naehsysteme GmbH, i.g., Alsdorf, Germany

[21] Appl. No.: 39,166

[22] PCT Filed: Aug. 11, 1992

[86] PCT No.: PCT/EP92/01836

§ 371 Date: Apr. 12, 1993

§ 102(e) Date: Apr. 12, 1993

[87] PCT Pub. No.: WO93/04228

PCT Pub. Date: Mar. 4, 1993

[30] Foreign Application Priority Data

Aug. 14, 1991 [DE] Germany ..... 4126849
Jul. 29, 1992 [DE] Germany ..... 4225008

[51] Int. Cl.[6] ..... D05B 3/00

[52] U.S. Cl. ..... 112/262.3; 112/262.2; 112/63; 112/121.14

[58] Field of Search ..... 112/262.3, 262.2, 265.1, 112/121.14, 10, 121.15, 121.12, 63, 2, 121.24, 104, 121.29

[56] References Cited

U.S. PATENT DOCUMENTS 4,756,261 7/1988 Gershoni ..... 112/262.3
4,862,815 9/1989 Thurner et al. ..... 112/262.3 X
4,905,615 3/1990 Pofferi ..... 112/121.14 X
5,163,376 11/1992 Frye ..... 112/121.14 X

FOREIGN PATENT DOCUMENTS 344400 1/1989 European Pat. Off. .
2129283 10/1983 United Kingdom .

*Primary Examiner*—Peter Nerbun
*Attorney, Agent, or Firm*—Diller, Ramik & Wight

[57] ABSTRACT

For forming three-dimensional envelopes of at least two blanks (11, 13) which are to be sewn together, the first blank (11) is laid on a first support surface of a carrier body (14) in such a manner that its edge portion projects beyond the carrier body. Thereafter, a second blank (13) is laid on a second support surface of the carrier body (14), the edge portions (11*a*, 13*a*) of both blanks projecting obliquely from the blanks and forming a double flange portion projecting from the carrier body (14). A sewing machine is guided along the root line (57) formed by the kink lines of the edge portions (11*a*, 13*a*) so that a seam interconnecting the blanks (11, 13) is created there.

11 Claims, 4 Drawing Sheets

FIG.1
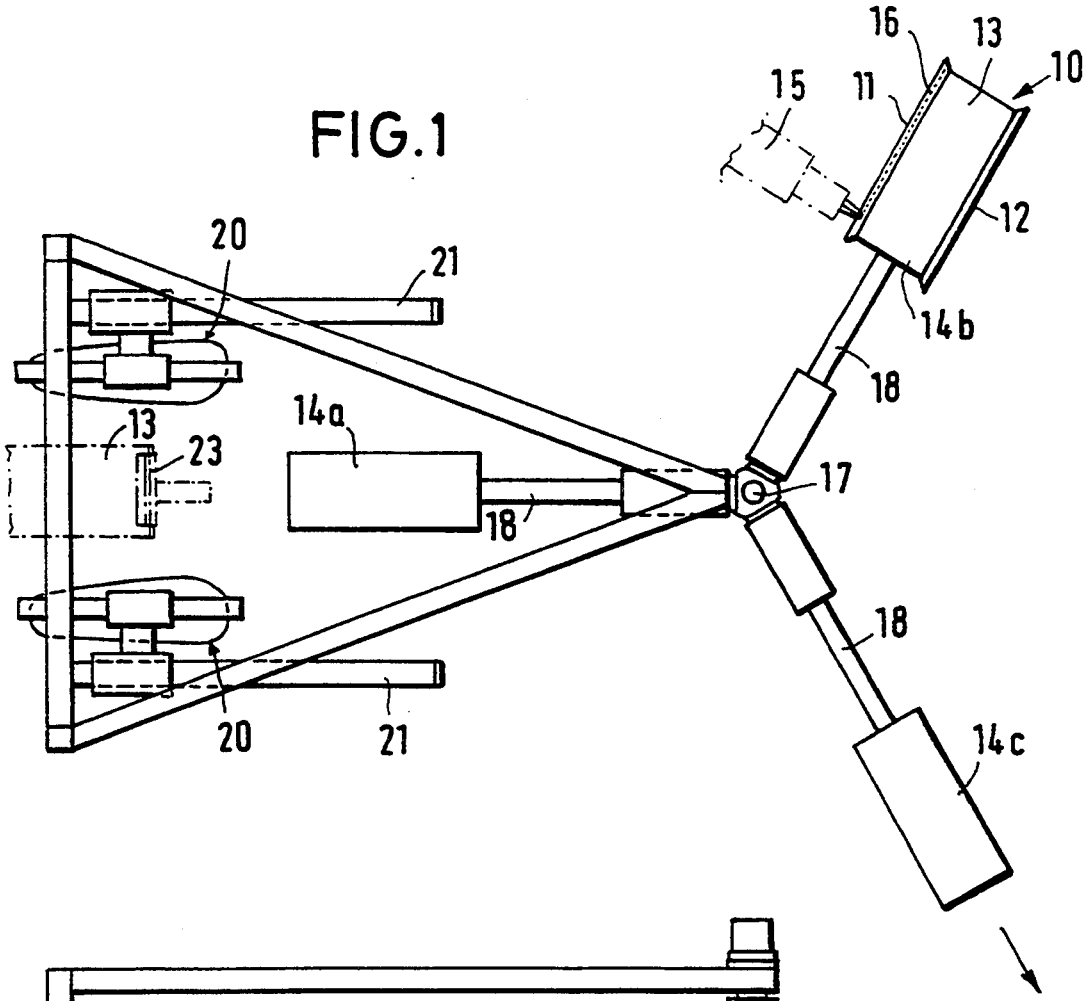
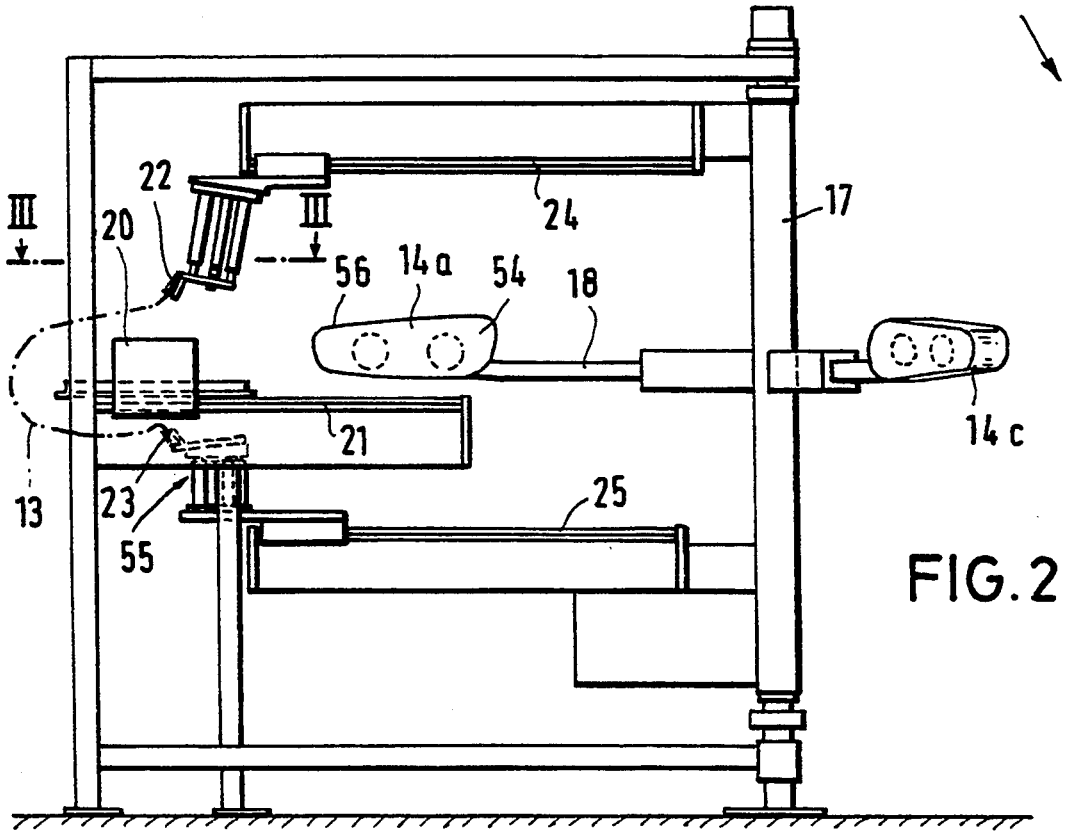
FIG.2

FIG.6
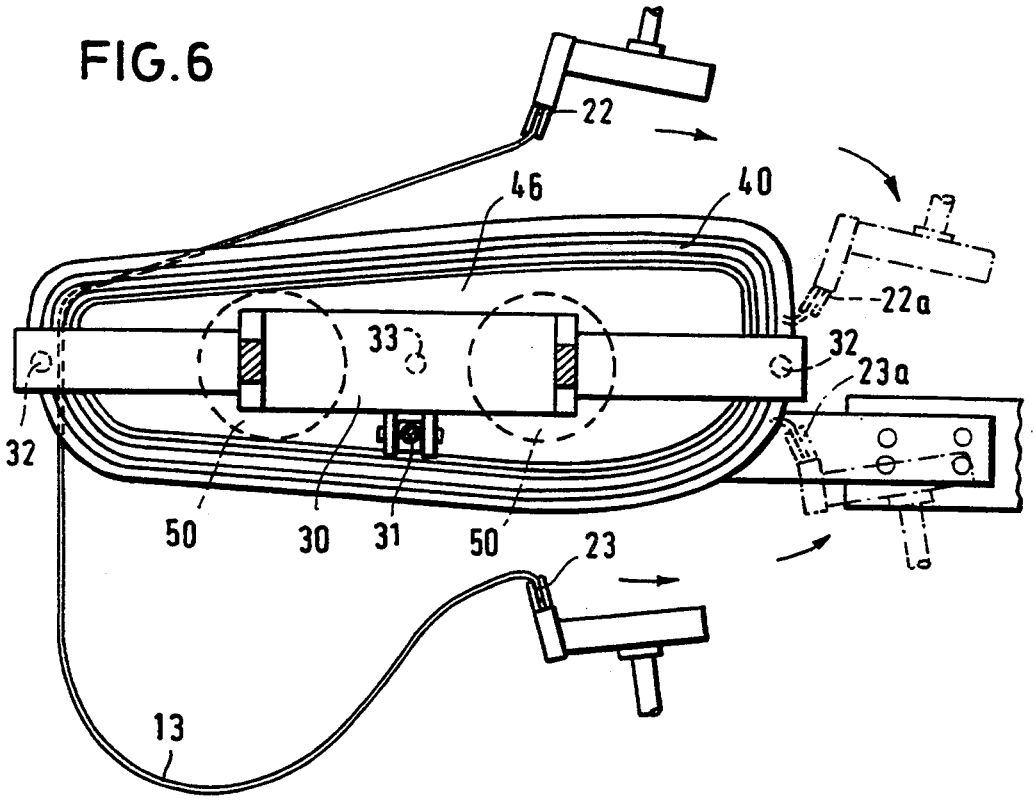
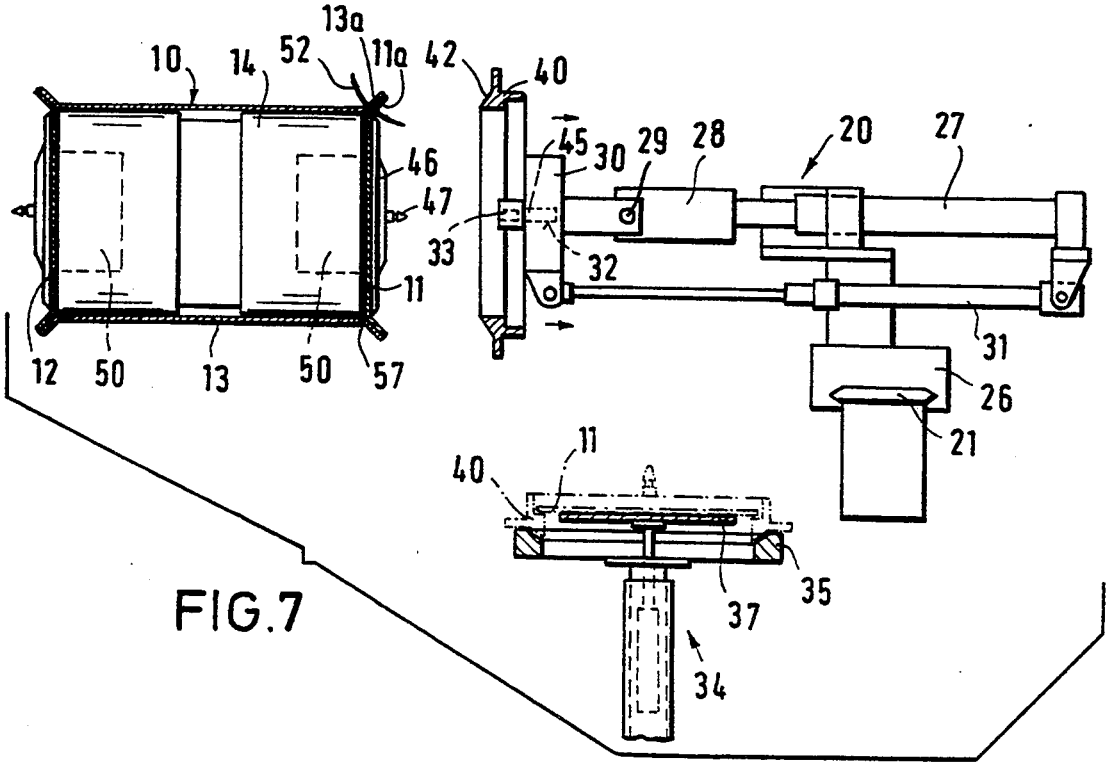
FIG.7

METHOD AND DEVICE FOR FORMING THREE-DIMENSIONAL ENVELOPES

BACKGROUND OF THE INVENTION

The invention relates to a method of forming three-dimensional envelopes from blanks.

Usually, sewn three-dimensional envelopes are manufactured by laying flat the blanks to be sewn together in a sewing machine and by passing them under the sewing foot of the sewing machine. The edges of the blanks are provided with marks which have to be placed matchingly one upon the other. This kind of sewing requires a high degree of skill. Nevertheless, it cannot be avoided that the blanks are displaced relative to each other during sewing which results in wave formations and gatherings in the envelope during manufacture.

The performance facilities of the sewing machine are not utilized owing to the relatively slow manual control.

From DE 33 38 405 A1, a method for manufacturing three-dimensional envelopes of articles provided with sewn seams is known, wherein blanks are fastened to a three-dimensional carrier body and a sewing machine fastened to a manipulator arm is moved along the intended seam line. The edges of the blanks are laid flat, one upon the other, on the carrier body, and the needle of the sewing machine is pierced through the edges into the carrier body. This requires the introduction of a rotating gripper into the interior of the carrier body for producing the seam.

In another method known from EP 0 344 400 A1 for sewing an arm sleeve into a jacket, the sleeve is inserted into the reversed jacket such that the edge of the sleeve opening is laid from the inside against the edge of the jacket opening (armhole). For sewing, a sewing machine is led around the edges lying together, the needle plate with the rotating gripper arranged beneath being introduced into the opening. A problem that arises is that the outer edge and the inner edge which is enclosed by the outer one have different diameters during the sewing process so that these edges, one lying within the other, are subject to forces.

SUMMARY OF THE INVENTION

It is the object of the invention to provide a method of and a device for forming three-dimensional envelopes, which, independently of the accuracy of the blanks to be sewn together, permit a manufacture of the envelope with a correct shape and size.

In German Patent Application P 41 02 840 (not prepublished), a method is described in which the seam is produced along the root line formed by the kink line of the edges.

In the method according to the present invention, the two blanks are laid on the carrier body such-that their edge portions abut face to face and form a double flange portion. The blanks which are positioned on the carrier body in this way are sewn together with at least one sewing machine along their edge portions lying together and projecting obliquely from the carrier body, which sewing machine makes the seam along the root line. Thus, not only a fast and exact positioning of the blanks to be sewn together is possible but also a proper creating of the seam without any creases or drawing.

The edges project obliquely from the two support surfaces, i.e. they form an angle with each one of these support surfaces, which is larger than 0° and smaller than 90°, preferably 45°. The intended seam line along which the needle of the sewing machine is guided extends exactly along the root line of the double flange portion formed by the abutting edge portions of the blanks, i.e. along the kink lines of the edge portions of the blanks. Subsequently, the work piece can be reversed so that the abutting edge portions of the blanks forming the double flange portion lie in the interior of the work piece. When manufacturing three-dimensional envelopes of plane blanks, this results in different lengths for the seam lines at the outer and the inner blank in the seam region. In the method according to the invention, both blanks are opposed in a form so that this length difference is created without any force. Any inaccuracies which might arise when manufacturing the blanks, or subsequent changes in their dimensions, do not have any influence on the final product.

In further keeping with the invention, the laying of the blanks on the carrier body, the sewing and the removal of the envelopes from the carrier body is respectively effected in another position of the carrier body with the carrier body being moved from one position to the next one. This has the advantage of a suitable division of the individual working processes for the industrial mass production as well as the advantage that the individual working steps can be carried out simultaneously when using several carrier bodies.

In further accordance with the invention, the at least two blanks to be sewn together are laid on the support surfaces of the carrier body, and the sewing machine is guided such that the seam is created along the root line where the first and the second support surface abut each other.

In a preferred embodiment of the invention, the first blank is spanned in the first lay-on device between a holding plate and a frame. The holding plate shapes the blank corresponding to the later shape of this blank and the frame serves for kinking the edge portion of the blank so that the useful area of the blank and the edge portion are already formed and defined in the holding device. Between frame and holding plate there is a gap which is adapted to the material thickness of the blank. In further accordance with the invention, the holding plate remains on the carrier body while the frame is removed from the carrier body. This has the advantage that during sewing the fixing of the first blank at the carrier body is maintained. The securement of the holding plate can be effected by magnets, by a suction device in the carrier body or in the holding plate or by means of another non-contacting pulling device which is capable of attracting the holding plate towards the carrier body through the blank. It is also possible to keep the holding plate mechanically pressed against the carrier body from the outside after the frame has been withdrawn.

The second blank or further blanks can be attached to the carrier body in the same way as the first blank. In this case, the devices for laying on the blanks are substantially equally constructed.

When the first blank is to be sewn together with the second blank along its entire periphery, the frame is suitably a closed frame. It is also possible, however, to use an open frame in the case that only a part of the periphery of the first blank is to be sewn together with the second blank. Therefore, the frame can also be a straight or curved bar.

Referring to the drawings, an embodiment of the invention is described in more detail hereinafter. In the drawings:

BRIEF DESCRIPTION OF THE DRAWINGS

FIG. 1 is a schematic plan view of a device for sewing three-dimensional envelopes, FIG. 2 is a schematic side view of the device according to FIG. 1, FIG. 6 is a sectional view along the line VI—VI of FIG. 5, and FIG. 7 shows the withdrawal of the frame from the carrier body as well as the deposition of the frame in the preparing station.

DESCRIPTION OF THE PREFERRED EMBODIMENTS

Figure 3:
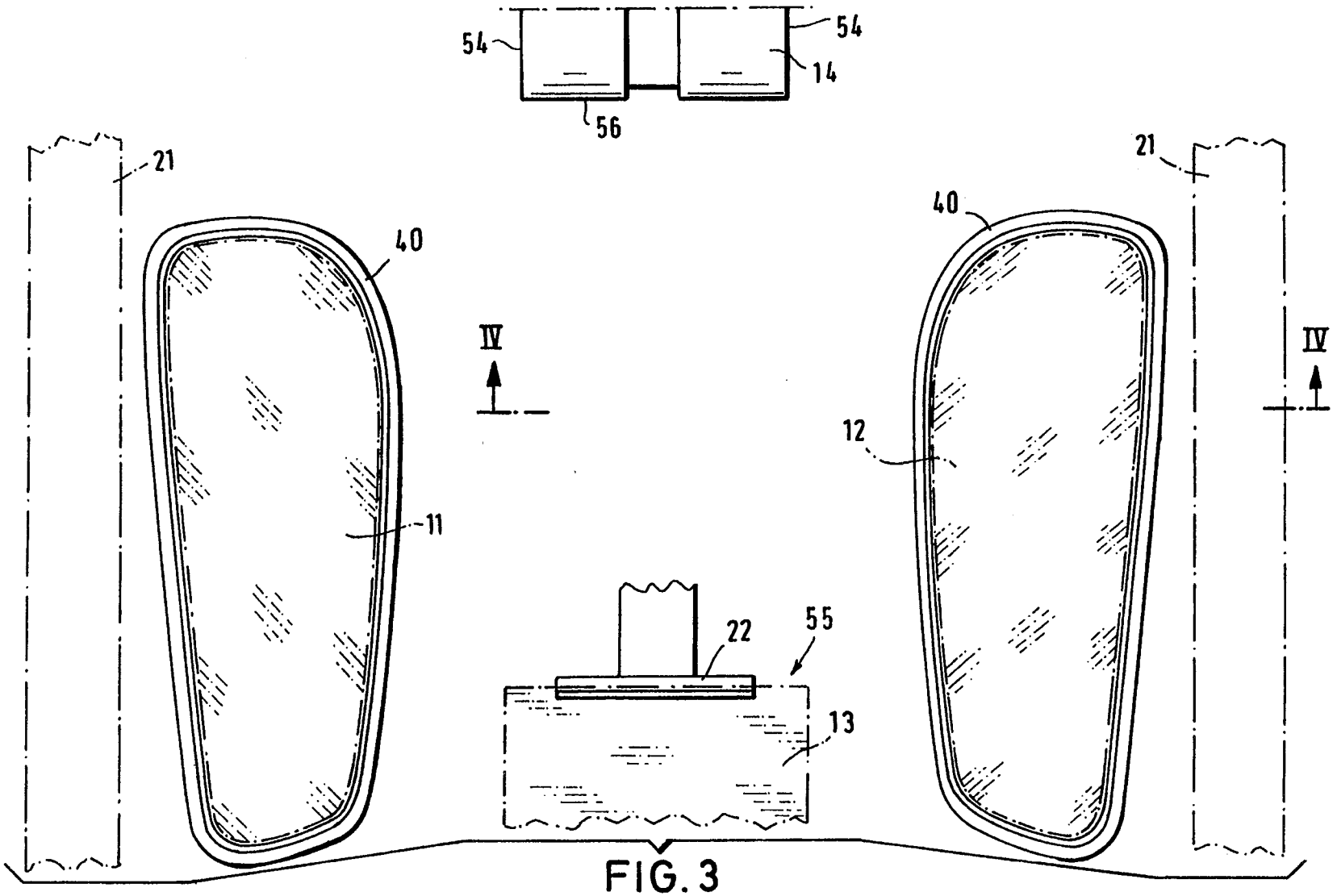
FIG. 3 is a schematic sectional view along the line III—III of FIG. 2 for illustrating the two first blanks which are gripped by the holding devices for being set against the carrier body, as well as the second blank which is subsequently pulled around the carrier body.

In the described embodiment, envelopes 10 for the armrests of motor vehicles are to be sewn, wherein two first blanks 11,12 form the end walls of the completed envelope, whereas a second blank 13 forms the peripheral wall of the envelope, each of its edge portions being sewn together with the edge portion of one of the first blanks 11,12.

A three-dimensional carrier body 14 having approximately the form of the envelope to be manufactured serves as carrier for the blanks. The blanks are fixed to this carrier body 14 with their edge portions being opposite to each other, in order to be sewn together by a sewing machine 15 which is guided by a manipulator. Subsequently, the envelope which has been manufactured in this way is reversed so that the seams 16 are inside.

The device illustrated in FIGS. 1 and 2 comprises a rotatable column 17 to which three arms 18 are mounted each of which carries a carrier body. When a carrier body is in the load position 14*a*, the blanks can be laid upon it. When the column 17 is rotated further, the carrier body reaches the sewing position 14*b* in which the obliquely projecting edge portions of the blanks which lie together are sewn together by the sewing machine 15. When the column 17 is rotated further, the carrier body reaches the discharge position 14*c* in which the completed envelope is removed from it.

In the load position 14*a* in which the carrier body is located, first lay-on devices 20 can engage on it from both sides for positioning the lateral first blanks 11,12 at the first support surfaces 54 of the carrier body 14. Each of the first lay-on devices 20 is displaceable along a rail 21 extending parallel to the carrier body.

In the load position 14*a*, the second blank 13 is laid by a second lay-on device 55 upon a second support surface 56 of the carrier body 14. The second lay-on device 55 comprises two grippers 22,23 which are movable on rails 24 and 25 parallel to the longitudinal direction of the carrier body 14 to grip the second blank 13 at its ends and pull it around the periphery of the carrier body and hold it there. The second lay-on device 55 follows the movements of the carrier body along the individual positions 14*a*,14*b*, and 14*c* and it firmly holds the blank 13 to the support surface 56 which is here the peripheral surface. As shown in the embodiment, the support surfaces do not necessarily have to be planar. Here, the support surface 56 is a curved surface. It is important that the support surfaces 54 and 56 join each other at an angle and form an edge portion.

Figure 4:
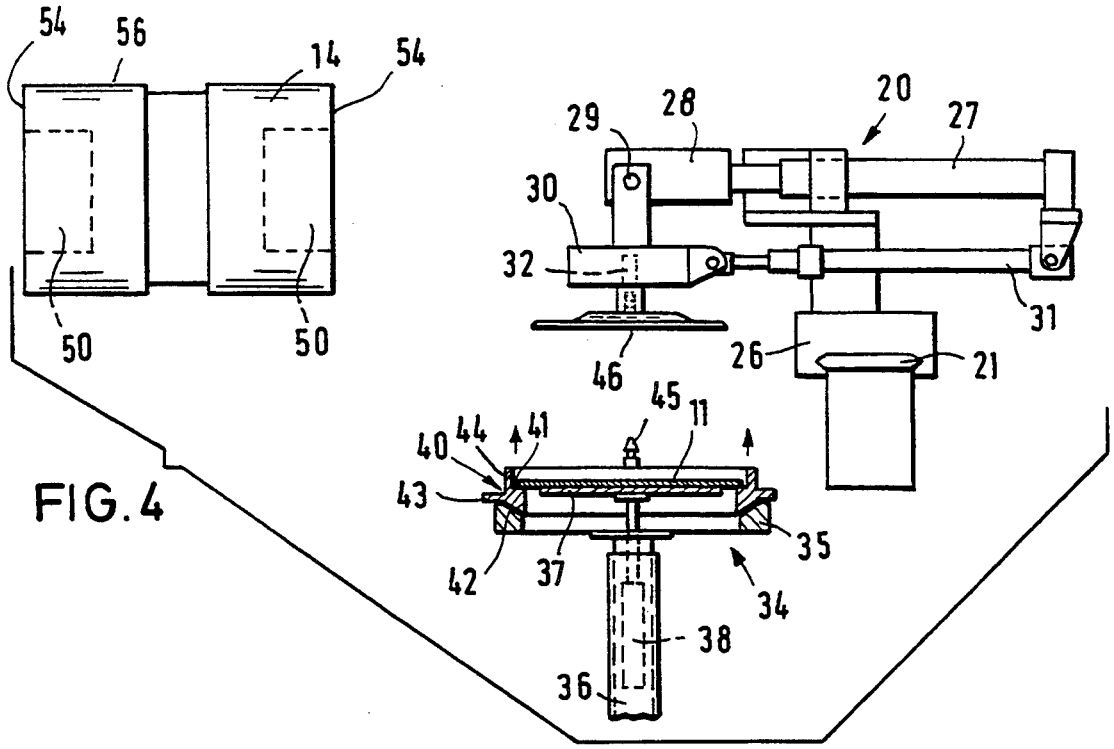
FIG. 4 is a sectional view along the line IV—IV of FIG. 3.

According to FIG. 4, each first lay-on device 20 comprises a carriage 26 which is displaceable along the respective rail 21 and supports a horizontal piston-cylinder unit 27. A headpiece 28 which is horizontally movable with the piston-cylinder unit 28 can be moved transversely to the longitudinal direction of the carrier body 14. Via a horizontal axis 29, a support 30 is mounted to the headpiece 28, which support is controlled by a piston-cylinder unit 31 in order to pivot the support 30 between the reception position illustrated in FIG. 4 and the take-off position illustrated in dash-dots in FIG. 5.

The support 30 is an elongate bar comprising reception holes 32 at its ends and a further reception hole 33 in its center.

Along the path of the lay-on device 20, the preparing station 34 is arranged at a stationary place. This preparing station comprises a holder 35 being configured as a support frame and having generally the shape of the respective first blank 11. The holder 35 is fastened to a lifting device 36 such that it can be lifted and lowered. In the inner free space of the holder 35, there is a support plate 37 which can be vertically moved relative to the holder 35 by a further lifting device 38 or against the force of a spring device.

According to FIG. 4, the frame 40 having generally the contour of the first blank 11 is inserted into the holder 35. According to FIG. 4, this frame has an inner shoulder 41 which is directed upwardly, an inclined shoulder 42 acting in the opposite direction of the inner shoulder 41 and a flange 43 projecting outwardly. A tube-shaped section 44 forming the rear end of the frame projects beyond the inner shoulder 41, while the inclined shoulder 42 forms the fore end of the frame.

The frame 40 is loosely inserted into the holder 35 configured as a support frame. The frame is held and thus centered at the short sides of the holder 35 in one clamp (not shown), respectively. The support plate 37 is located at about the same height as the inner shoulder 41. The blank 11 is laid on this support plate 37 such that it projects beyond the edge of the support plate and lies on the inner shoulder 41.

The frame 40 comprises two backwardly projecting pegs 45 which enter into the reception holes 32 of the holder and can be locked there by controlled bolts.

Further, the holding plate 46, which carries a backwardly projecting peg 47, can be inserted into the frame 40, which peg can be inserted into and locked in the reception hole 33 of the holder 30. After pressing the blank into the frame 40, the latter is taken over by the pegs 45 in bores of the holder 30 and lifted upwardly together with the holding plate 46 and the cloth 11.

Figure 5:
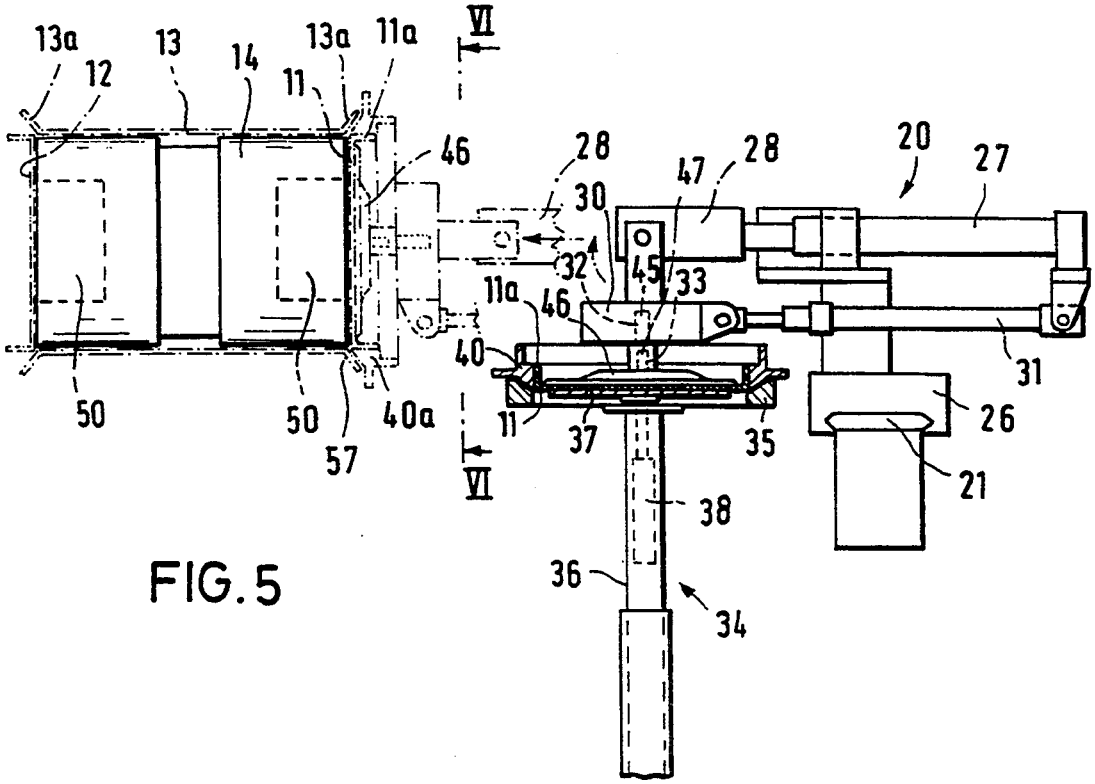
FIG. 5 shows the transfer of a first blank from the preparing station to the transfer device, as well as the further transfer from the transfer device to the carrier body.

In the position illustrated in FIG. 4, the holder 35 with the frame 40 and the support plate 37 is elevated by the lifting device 36, the pegs 45 entering into the reception holes 32 for being locked. The support plate 37 with the blank 11 placed upon it abuts against the holding plate 46 and recedes under the effect of the lifting device 38, as shown in FIG. 5. Thereby, the edge portion 11*a* of the blank 11 is kinked backwardly around the edge of the holding plate 46 and abuts against the inner surface of the frame 40. Since the outer diameter of the holding plate 46 is only insignificantly smaller than the inner diameter of the frame 40, the edge portion 11*a* is spanned between holding plate and frame, as can be seen in FIG. 5. As holding plate and frame are now jointly connected to the support 30, they remain at this support, while the holder 35 is lowered by the lifting device 36. Now, the carriage 26 is displaced along the rail 21. The piston-cylinder unit 31 pivots the support 30 about its horizontal axis in the position illustrated in dash-dots in FIG. 5, and the piston-cylinder unit 27 moves the support 30 toward the carrier body 14 until the frame 40 touches the front face of the carrier body in the position 40*a*. In this state, the holding plate 46 is still in the frame 40 to span the blank 11.

After the blank 11 has abutted against the front support surface 54 of the carrier body 14, the second blank 13 is pulled around the carrier body by the grippers 22 and 23, as can be seen in FIG. 6. Shortly before the end phase, the grippers 22,23 take the positions 22*a* and 23*a* illustrated in broken lines and in the end phase, the cloth ends touch each other. The edge portion 13*a* of second blank 14 laterally projects beyond the carrier body 14 and there, it is laid oh the inclined shoulder 42 of the frame 40.

The carrier body 14 contains holding devices 50 which are configured as solenoids here and which, when excited, attract the holding plate 46. After both blanks 11 and 12 have been attached to the carrier body, the holding device 50 is activated. At the same time, the locking of the peg 47 of the holding plate at the support 30 is released. Now, the holding plate 46 is held by the holding device 50 at the carrier body 14 through the blank 11, while the frame 40 is removed from the carrier body 14 together with the support 30. Since the edge portion 11*a* of the first blank 11 is now released from the force of the frame 40, it partially recedes and abuts on the edge portion 13*a* of the second blank 13. The abutting edge portions 11*a* and 13*a* form an obliquely projecting double flange portion. Along the root line 57 of this double flange portion, the seam is produced by the sewing machine 15 according to FIG. 1 after the respective carrier body has been pivoted in the position 14*b* according to FIG. 1.

In FIG. 7, the needle 52 of the sewing machine 15 is schematically shown in order to illustrate at which place of the blanks 11,13 the seam is produced. Both blanks 11 and 13 are laid upon the support surfaces of the carrier body 14 which are arranged in an angle relative to each other, without any creases or distortions. Then, the needle 52 is guided along the intended seam line which precisely extends along the kink line which is located at the foot of the double flange formed by the two abutting edge portions 11*a* and 13*a* of the blanks. When sewing exactly along this root line 57, i.e. along an edge line of the-carrier body 14, this results in the correct seam course of the three-dimensional envelope without the formation of any creases or distortions by the seam.

After the sewing is finished, the two holding plates 46 are temporarily removed from the carrier body 14 in the position 14*b* or in the position 14*c* according to FIG. 1. Then, in the position 14*c*, the carrier body 14 is laterally diminished in a telescopic manner so that its width reduces and the envelope is no longer tight on the carrier body 14. The slack envelope is then taken off the carrier body and simultaneously, if necessary, its inner side is reversed to the outside, and, after the holding plates have been laid on again, the carrier body is moved again to the position 14*a* in order to receive blanks again. The frame 40 remains at the carrier 30 of the transfer station 20. This carrier 30 is brought into the vertical position above the preparing station 34 and set upon the holder 35, as shown in FIG. 7. By means of the carrier 30, the holding plate 46 is then detached from the carrier body 14 so that the state shown in FIG. 4 is reached again, in which a new blank 11 can be laid on the support plate 37 and the frame 40.

Although a preferred embodiment of the invention has been specifically illustrated and described herein, it is to be understood that minor variations may be made in the apparatus without departing from the spirit and scope of the invention, as defined the appended claims.

We claim:

1. A method of forming a three-dimensional envelope from at least two blanks which are sewn together at abutting edge portions while supported upon a carrier body comprising the steps of:

a) laying a first blank (11) on a first support surface (54) of a carrier body (14) such that an edge portion (11*a*) of said first blank (11) projects beyond said carrier body (14), b) laying at least a second blank (13) on a second support surface (56) of said carrier body (14) which extends at an angle with respect to said first support surface (54) with an edge portion (13*a*) of said second blank (13) protecting at an angle to said second support surface (56) such that the edge portions (11*a*, 13*a*) of both blanks (11, 13) jointly from a double flange portion projecting from said carrier body (14), and c) producing a seam (16) to interconnect the edge portions 11*a*, 13*a*) by effecting a relative movement between a sewing machine and said double flange portion along a root line (57) formed by kink lines of said edge portions (11*a*, 13*a*) of said blanks (11, 13) to thereby form an envelope.

2. The method as defined in claim 1 wherein before at least one of said blanks (11, 13) is laid on its associated support surface the blank is kinked along its root line (57).

3. The method as defined in claim 1 wherein said carrier body (14) is brought to a load position (14*a*) whereat said blanks (11, 13) are laid thereon, said carrier body (14) is then moved into a sewing position (14*b*) wherein sewing is effected by said sewing machine along said root line (57), and said carrier body (14) is moved thereafter into a discharge position (14*c*) whereat said envelope is removed from said carrier body (14).

4. A device for forming a three-dimensional envelope from at least two blanks which are sewn together at abutting edge portions comprising a carrier body (14) including supporting faces (54, 56) defining an angle with respect to each other upon which blanks (11, 13) can be laid and sewn together along edge portions (11*a*, 13*a*) thereof, lay-on means (20) for laying a first blank (11) upon a first support surface (54) of said carrier body (14), second lay-on means (55) for laying a second blank (13) upon a second support surface (56) of said carrier body (14) which extends at an angle with respect to said first support surface (54), a sewing machine (15), and means for controlling said sewing machine (15) to form a seam (16) along a root line (57) at which said first and second support surfaces (54, 56) abut each other.

5. The device as defined in claim 4 including means for moving said first lay-on device means (20) between a loading position and a discharge position relative to said carrier body (14), said lay-on device means (20) includes a holding plate (46) and a frame (40), an edge of said holding plate (46) corresponds to an edge of said first support surface (54) while leaving a gap, and means for moving said frame (40) to kink said edge portion (11*a*) of said first blank (11) which projects beyond said holding plate (46).

6. The device as defined claim 5 including means for detachably mounting said holding plate (46) to said first lay-on device (20) which supports said frame (40), and said first lay-on device (20) is removable from said carrier body (14) together with said frame (40) after said holding plate (46) has been transferred to said carrier body (14), while only said holding plate (46) together with said first blank (11) remains on said carrier body.

7. The device as defined in claim 6 including a preparing station (34) for receiving said frame (40) such that said first blank (11) can be inserted therein, and said first lay-on device (20) introduces said holding plate (46) into said frame (40) and transfers both and said first blank to said carrier body (14).

8. The device as defined in claim 6 wherein said first lay-on device (20) includes a carrier (30) for said frame (40) and said holding plate (46), carrier being pivotable about a horizontal axis (29, and said preparing station (34) is arranged beneath said first lay-on device (20).

9. The device as defined in claim 8 wherein said preparing station (34) includes a holder (35) which can be lifted and lowered and upon which said frame (40) is laid.

10. The device as defined in claim 9 wherein said preparing station (34) includes in said holder (35) a support plate (37) which can be lifted and lowered.

11. The device as defined in claim 6 wherein said frame (40) includes an inclined shoulder (42) for lifting said edge portion (13*a*) of said second blank (13) at a side thereof facing said carrier body (14).

* * * * *